United States Patent [19]

Pötz et al.

[11] Patent Number: 4,657,154

[45] Date of Patent: Apr. 14, 1987

[54] CONTAINER HAVING A LATCHABLE COVER

[75] Inventors: Franz Pötz, Heppenheim; Franz-Wolfgang Popp, Wedemark; Wolfgang Oswald, Ladenburg, all of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 866,070

[22] Filed: May 20, 1986

[30] Foreign Application Priority Data

May 21, 1985 [DE] Fed. Rep. of Germany ..... 3518181

[51] Int. Cl.[4] ..... B65D 39/02

[52] U.S. Cl. ..... 215/273

[58] Field of Search ..... 215/273, 280; 220/324

[56] References Cited

U.S. PATENT DOCUMENTS 724,794 4/1903 Brewington ..... 215/273

*Primary Examiner*—Donald F. Norton

*Attorney, Agent, or Firm*—Walter Ottesen

[57] ABSTRACT

In containers having latchable covers for closing the container vessel, the covers are rigidly connected to the vessel opening and this condition can be disadvantageous under various load conditions. To attain a flexible yet secure closure, the cover is provided with an annular groove formed in the peripheral edge thereof. The cover is thereby capable of yielding under stress. For tensioning the cover, a device can be fixed in a recess formed in the inner wall surface of the vessel. Upright supports project out from a plate and are in contact engagement with an end face of the cover remote from a shoulder formed in the inside wall surface of the vessel opening. A tensioning unit is subjected to pressure and then presses the cover together in the region of the annular groove. After the latches are inserted into a recess, the tensioning unit is relieved of stress. The latches are then wedged in by the resilient action of the cover to produce a simple and reliable connection.

16 Claims, 5 Drawing Figures

CONTAINER HAVING A LATCHABLE COVER

FIELD OF THE INVENTION

The invention relates to a container including a vessel defining an opening and a cover supported on a shoulder of the vessel opening. The inside of the vessel opening has a recess into which a plurality of latches can be inserted for tightly holding the cover.

BACKGROUND OF THE INVENTION

A container of this kind is known from published German patent application DE-OS No. 27 38 592. In this prior art, both a shielding cover and a retaining cover are provided for the container. The retaining cover has a great number of parts that are movable relative to one another with frictional engagement, which serve to tightly hold the cover. In these parts, which slide underneath one another, it is impossible to preclude corrosion or soiling, which may finally cause functional problems. The wedging of the latches produces a rigid connection, which may be disadvantageous under various loads that may be applied to the container.

SUMMARY OF THE INVENTION

Accordingly, it is an object of the invention to provide a latching device for a container of the kind described above, which is simple in structure and effects a secure closure, yet has a certain flexibility.

According to the invention, this object is attained by making the cover in one piece and providing it with an annular groove formed in its circumferential edge face such that the cover is capable of yielding resiliently under load in the region of the annular groove. The connection is flexible because of the yielding distance provided by the annular groove and can compensate for critical loading situations.

In one embodiment of the container of the invention, the cover of the container is fixed in position by providing a device braced in a recess of the vessel opening for initiating or discontinuing the stress in the cover. The bracing elements for the device are connected to a retaining plate, which in turn supports tensioning cylinders engaging the end face of the cover remote from the shoulder. The bracing elements serve as a fixed point for the tensioning cylinders, which press the cover together in the region of the annular groove. The unstressed latches are inserted or retracted while the cover is in the pressed-together state. If the tensioning force of the tensioning cylinders is discontinued, then with the latches already inserted into position, a force-tight connection is established between the cover and the vessel opening. The device need not remain in the region of the vessel opening.

Preferably, a cylinder mounted on the holding plate or on the plate of the device carries a bracing member and moves this member relative to one or two recesses formed in the inside wall surface of the vessel opening.

In another embodiment of the container of the invention, the cover is fixed in position in that the tensioning unit for initiating or discontinuing the tension of the cover fits over the vessel opening, and in that a plurality of upright supports project out from a side of the tensioning unit facing toward the vessel; these upright supports are in contact engagement with the surface of the cover between the latches. Bracing members of the device engage the recess, on the one hand, and are connected to the tensioning unit on the other. Because only a single tensioning unit is used, pressure is exerted uniformly on the cover.

According to a preferred embodiment, the inside of the vessel opening has a second recess, located above the first recess, and the bracing members of the device selectively engage the first and/or second recess.

Preferably, a cylinder secured on the holding plate or on the plate of the device has a bracing member, which it moves relative to one or both recesses.

A further embodiment includes a tensioning unit comprising two parallel plates and a folding bellows connecting the plates; a plurality of tension rods joined to the bracing members and penetrating both the plates and the chamber defined by the plates which is acted upon by a pressure medium; and, a yoke resting against the top of the upper plate, for each tension rod on its end remote from the bracing member. The bracing member and the yoke effect a rigid connection between the upper plate of the tensioning unit and the vessel opening, so that when pressure is exerted on the tensioning unit, the cover yields in the region of its annular groove.

Preferably, each tension rod is surrounded by a protective sleeve, which spans the space between the plates and is joined thereto in a seal-tight manner.

To avoid having to penetrate the tensioning unit, which is acted upon by a pressure medium, and hence to avoid having to provide a seal for the tension rods, the tensioning unit can comprise two parallel plates and a folding bellows connecting the plates with one another. With the periphery of the plates protruding beyond the folding bellows, a tension rod joined to each bracing member then penetrates the portion of the plates projecting beyond the folding bellows, and on its end remote from the bracing member, each tension rod is again provided with a yoke that rests on the top of the upper plate.

In a preferred embodiment, a cylinder for inserting and retracting a latch is supported by the device and can be coupled with the end of a latch remote from the inside wall surface of the vessel opening. This assures that the device can be removed from the vessel opening whenever the latch is in either the open or the closed position.

To compensate for the movement of the bracing members relative to a recess formed in the vessel opening, the connection between the yoke and the tension rod is effected via a pivot pin, and the tension rod is rotatable relative to the pivot pin.

BRIEF DESCRIPTION OF THE DRAWING

The invention will now be described with reference to the drawing, wherein.

DESCRIPTION OF THE PREFERRED EMBODIMENTS OF THE INVENTION

Figure 1:
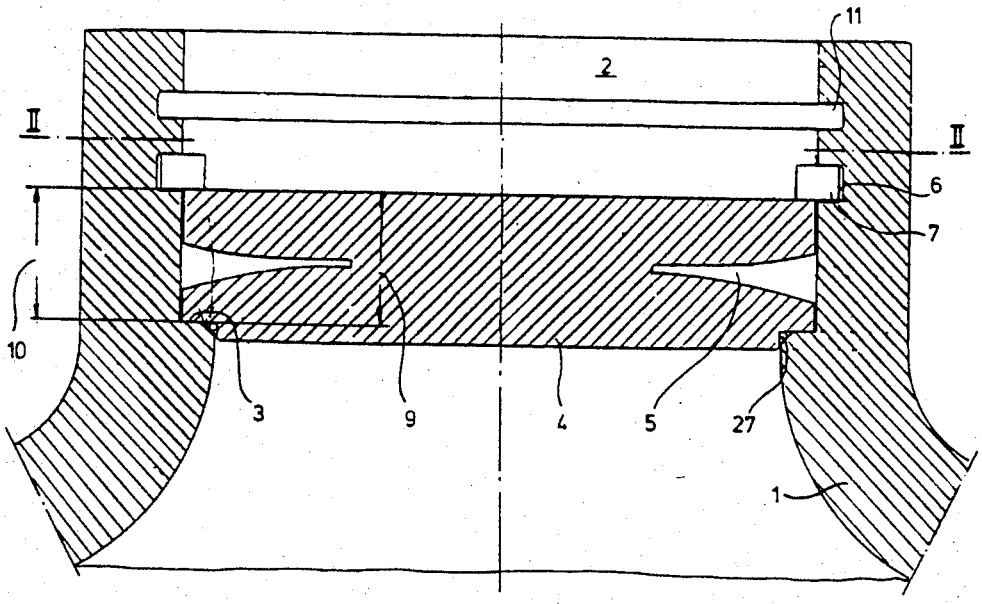
FIG. 1 is an elevation view, in section, taken through the upper portion of a container according to the invention showing the latchable cover in the braced or tensioned condition.
Figure 2:
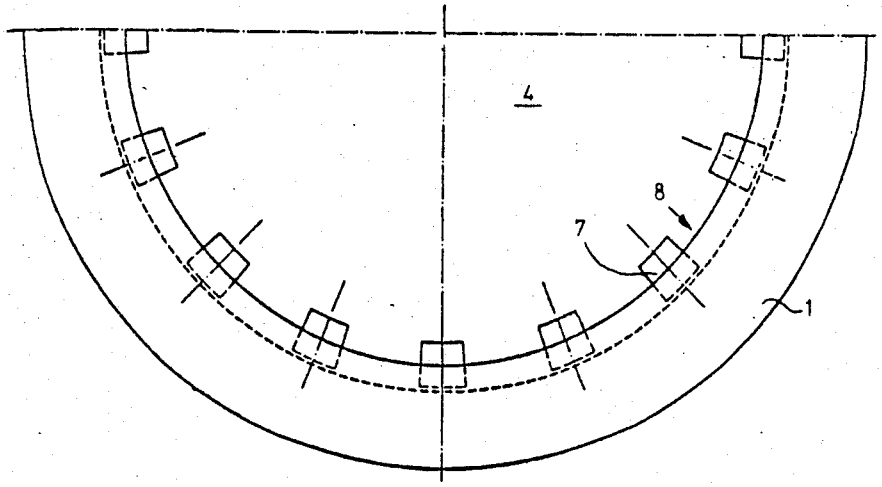
FIG. 2 is a view taken along the line II—II of FIG. 1.

FIG. 1, in a sectional view, shows part of a container having a vessel 1, which is used for instance as a pressurized container or vacuum container. The vessel opening 2 has a shoulder 3 for receiving and bracing a cover 4 of circular cross section thereon. An annular groove 5 is provided in the cover at the peripheral edge thereof. Because of the annular groove, when a force is applied to the side faces of the cover, the cover yields resiliently in the region of the annular groove. In a recess 6 formed in the inside of the opening 2, a plurality of latches 7 (see FIG. 2) are introduced in the direction of the arrow 8, and together with the resilient configuration of the cover 4, they effect a simple and reliable fixation of the cover relative to the container opening. The thickness 9 of the unstressed cover 4 is greater than the dimension 10 between the shoulder 3 and the lower side face of the recess 6. By the exertion of force, the cover can be pressed together in the region of the annular groove 5 to such an extent that its thickness 9 becomes equal to or less than the dimension 10. With the cover under stress, it is easy to introduce the latches 7 or to retract them if the cover is to be removed. The resilient force of the cover 4 can be determined for a particular application by varying the depth, location and shape of the annular groove. In the embodiments shown, the annular groove 5 has a wedge-like cross section, the flanks of which are convex.

Figure 3:
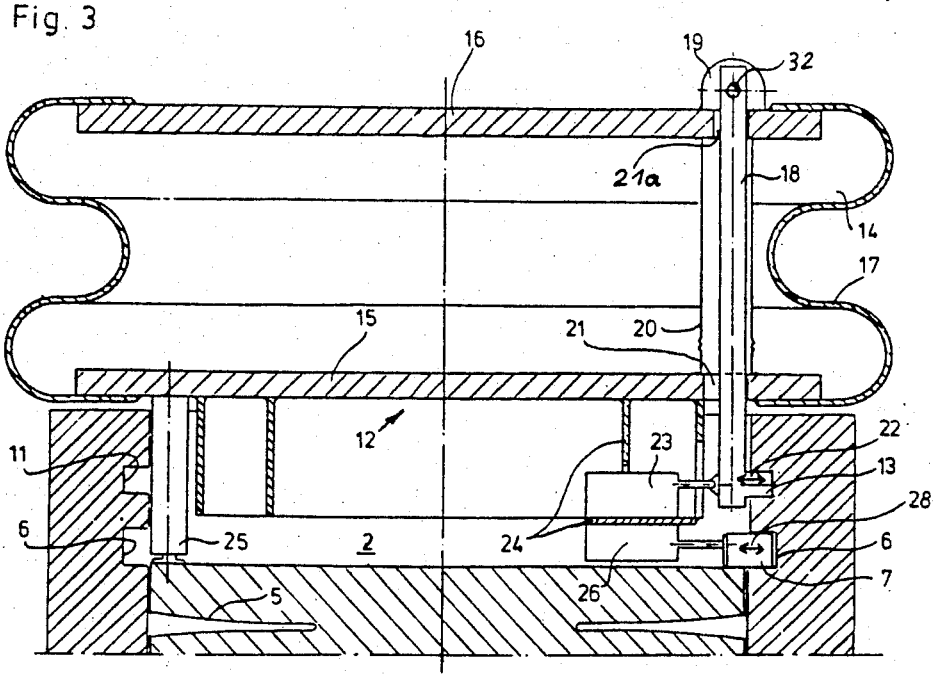
FIG. 3 is a longitudinal section taken through part of a container vessel, the cover and a tensioning unit for initiating or discontinuing the tensioning of the cover.

Referring also to FIG. 3, a device 12 is shown for initiating or discontinuing the bracing of the cover 4. To this end, a further recess 11 is formed in the inside of the vessel opening 2. A plurality of bracing members 13 of the device 12 can be introduced into this recess 11, forming an abutment during the process of tensioning the cover 4. The tensioning unit 14 of the device 12 is made of two parallel plates 15, 16, which are joined to one another by a folding bellows 17. The hollow space formed thereby can be acted upon by a pressure medium. Each bracing member 13 is joined to a tension rod 18. The tension rod 18 penetrates the tensioning unit 14 and is provided on its free end with a yoke 19, which rests against the top of the plate 16. Between the plates 15 and 16, the tension rod 18 is surrounded by a protective sleeve 20, which is secured on the inside of the plates in a seal-tight manner, to prevent any escape of the pressure medium through the pass-through openings 21 in the plates 15 and 16.

The openings 21 are configured as slots so as not to hinder the movements of the tension rods 18 together with the bracing members 13 in the direction of the arrow 22. To compensate for the movement in the direction of the arrow 22, the connection between the yoke 19 and the tension rod 18 is a pin connection defined by a pivot pin 32. The pivot pin 32 is fixedly joined to the yoke 19 and therefore permits a rotational movement of the tension rod 18 relative to the pivot pin. The movement in the direction of the arrow 22 is effected by means of a cylinder 23 actuated by a pressure medium. The cylinder 23 has its fixed point on a bracket 24 of the plate 15 and is hinged with its piston to the bracing member 13. Sixteen upright supports 25 project out from the underside of the plate 15, and their length is dimensioned such that with their free ends they contact the top of the cover whenever the bracing members 13 have been introduced into the further recess 11. The upright supports 25 are each in contact engagement with the cover surface between two latches 7, because at these points of engagement located on the periphery of the cover, the resilient force of the cover can be overcome with the least exertion of force.

If the tensioning unit 14 is now subjected to pressure, then because of the rigid connection of the tension rods 18 distributed about the periphery, the upper plate 16 of the tensioning unit 14 is held in its position relative to the opening of the vessel, while the plate 15 with the supports 25 is moved as far downwardly as the resilient deflection of the cover 4 allows. Depending on whether the latching is to be released, or effected, then during the application of pressure on the cover, the latches 7 are either introduced into the recess 6 or retracted therefrom; this is achieved with the aid of a cylinder 26 acted upon by a pressure medium. If the stress on the tensioning unit 14 is relaxed while the latches 7 are in the inserted position, then the latches become wedged in place by the resilient force of the cover, thereby assuring reliable closure of the container.

The cover seal 27 (FIG. 1) rests against a beveled face of the container vessel 1, so that the cover 4 is seated directly on the shoulder 3 of the vessel opening 2.

To control the movement of the latches 7 in the direction of the arrow 28, the cylinder 26 associated with each latch 7 is secured to the same bracket 24 as the cylinder 23. The end of a latch 7 facing away from the inside wall of the vessel opening is connected to the piston rod of the cylinder 26 so that it can be coupled and uncoupled. This assures that the device 12 can be removed after the tensioning process has been performed.

Figure 4:
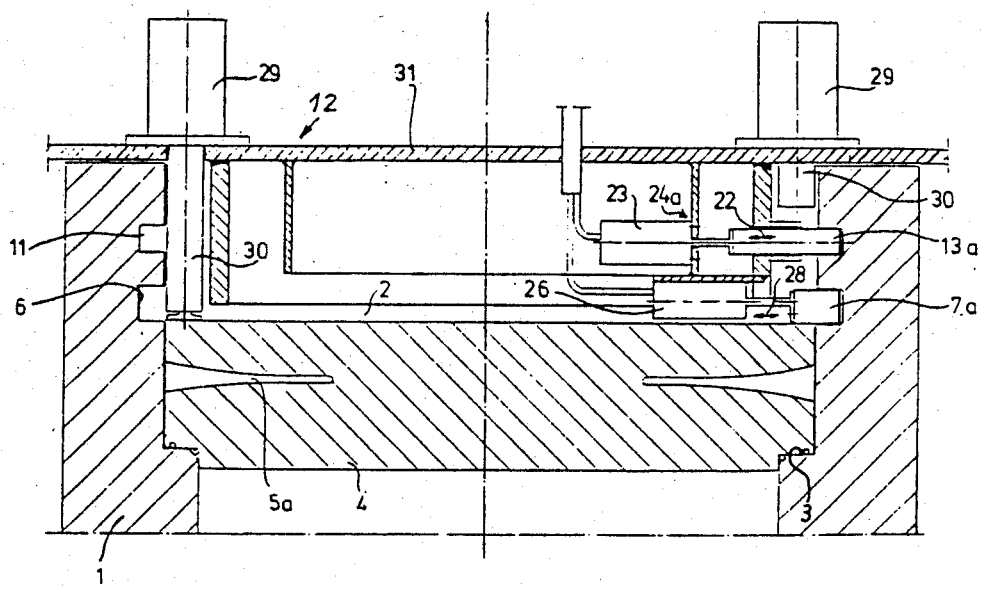
FIG. 4 shows another embodiment of the tensioning unit.

Another embodiment of the device 12 is shown in FIG. 4. There, the bracing of the cover 4 is performed with sixteen tensioning cylinders 29, the pistons 30 of which extend between the bracing members **13*a* and latches 7*a* and contact the side face of the cover 4 lying opposite the shoulder 3. The tensioning cylinders 29 are supported by a retaining plate 31 which is fixable in position relative to the vessel opening 2 via the bracing members 13*a*, which are insertable into and retractable out of the recess 11**.

The cover 4 is pressed together in the region of the annular groove **5*a* by the tensioning cylinders 29 relative to the retaining plate 31 which serves as an abutment. Just as in the embodiment shown in FIG. 3, the bracing members 13*a* and latches 7*a* are movable in the direction of the arrows 22 and 28 with the aid of cylinders 23 and 26, respectively. The cylinders 23 and 26 are secured on brackets 24*a* of the retaining plate 31**.

If the existing pressure and available space permit, the further recess 11 may be omitted. The bracing members 13, **13*a* of the tensioning unit 12 then engage the recess 6 between the latches 7, 7*a*. In that case, provision must be made to assure that sufficient space still remains for the upright supports 25 or pistons 30. If the container vessel 1 has both recesses 6, 11, then it also becomes possible to cause a number of bracing members 13, 13*a* to enter into engagement with one recess 6, and a further number to enter into engagement with the other recess 11**.

Figure 5:
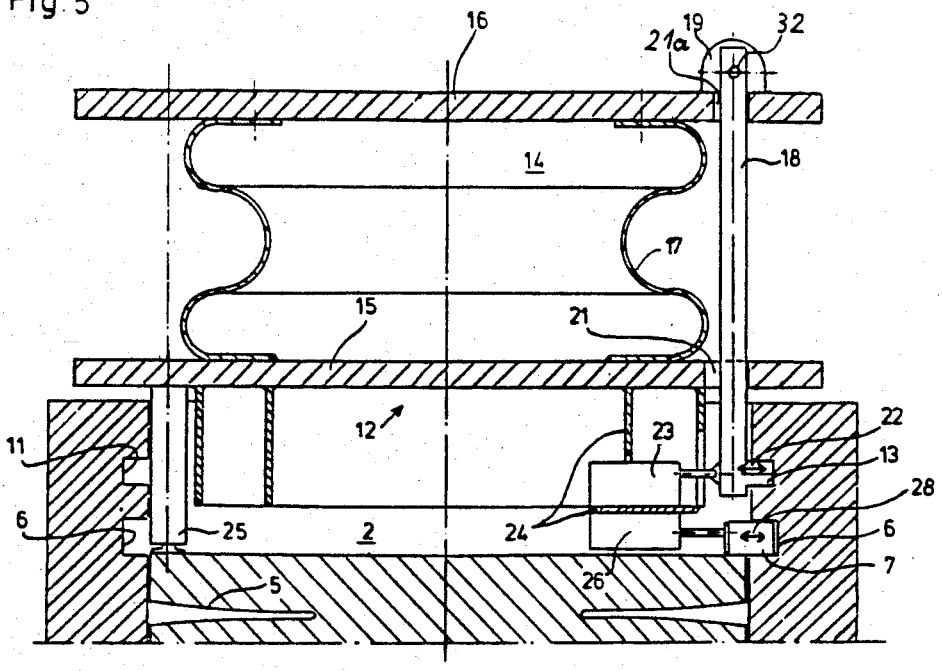
FIG. 5 shows another configuration of the tensioning unit according to FIG. 3.

Another embodiment of the tensioning unit 14 of FIG. 3 is shown in FIG. 5. In contrast to the embodiment of FIG. 3, the tension rods 18 here penetrate the peripheral area of the plates 15, 16 located outside the folding bellows 17. Accordingly, the tension rods 18 do not have to be sealed relative to the interior of the tensioning unit 14.

It is understood that the foregoing description is that of the preferred embodiments of the invention and that various changes and modifications may be made thereto without departing from the spirit and scope of the invention as defined in the appended claims.

What is claimed is:

1. A container comprising:

a vessel having an upwardly extending wall terminating in an upper end portion defining the opening of said vessel;

a removable cover for closing said opening;

said upper end portion having an inner wall surface with a shoulder formed therein for receiving said cover thereon when the container is closed;

said cover being one unitary piece having a peripheral edge;

annular groove means formed in said peripheral edge for causing said cover to be resiliently yieldable in response to a load applied to said cover in the region of said groove means;

recess means formed in said inner wall surface; and, latching means for engaging said recess means when said cover is loaded and holding said cover in place against said shoulder when said load is removed therefrom.

2. The container of claim 1, comprising a device for initiating and discontinuing the application of said load to said cover, said device including: a holding plate disposed in spaced relationship to said cover; bracing means connected to said plate and adapted for engaging said recess means for bracing said device relative to said vessel; and, tensioning means mounted on said plate for applying said load to said cover.

3. The container of claim 2, said holding plate having a face directed away from said shoulder, said bracing means including a plurality of bracing elements connected to said plate and adapted for engaging said recess means for bracing said device relative to said vessel; and, said tensioning means including a plurality of tensioning cylinders supported on said face of said plate for applying said load to said cover.

4. The container of claim 3, said recess means including two recesses formed in said inner wall surface and disposed one above the other, said bracing elements being adapted for engaging at least one of said recesses.

5. The container of claim 4, each of said bracing elements including: a bracing member movably mounted for engaging and disengaging one of said recesses; and, cylinder means fixedly mounted on said plate for actuating and displacing said bracing member with respect to said one recess.

6. The container of claim 5, said latching means including a plurality of latching members movably mounted for engaging and disengaging one of said recesses; and, said device including a plurality of cylinder units mounted thereon and adapted for coupling and uncoupling corresponding ones of said latching members at the ends thereof facing away from said one recess.

7. The container of claim 1, said latching means including a plurality of latching members spaced one from the other about the periphery of said cover; the container further comprising a device for initiating and discontinuing the application of said load, said device including: a tensioning unit extending over said opening and having an end face adjacent said cover, said tensioning unit being adapted for developing said load and having a plurality of supports extending outwardly therefrom so as to be in contact engagement with the surface of said cover for applying said load thereto, said supports being arranged so as to apply said load at respective locations between each two mutually adjacent ones of said latching members; and, bracing means for bracing said tensioning unit with respect to said vessel as said load is applied to said cover.

8. The container of claim 7, said bracing means including a plurality of bracing elements being connected on the one hand with said tensioning unit and engaging said recess means on the other hand.

9. The container of claim 8, said recess means including two recesses formed in said inner wall surface and disposed one above the other, said bracing elements being adapted for engaging at least one of said recesses.

10. The container of claim 9, said tensioning unit having a first plate defining said end face, each of said bracing elements including: a bracing member movably mounted for engaging and disengaging one of said recesses; and, cylinder means fixedly mounted on said plate for actuating and displacing said bracing member with respect to said one recess.

11. The container of claim 10, said latching members being movably mounted for engaging and disengaging one of said recesses; and, said device including a plurality of cylinder units mounted thereon and adapted for coupling and uncoupling corresponding ones of said latching members at the ends thereof facing away from said one recess.

12. The container of claim 8, said tensioning unit including: two mutually parallel plates disposed one above the other and in spaced relationship to each other, the lower one of said plates defining said end face; and, a bellows connecting said plates to each other so as to cause said bellows and said plates to conjointly define a chamber for receiving a pressure medium therein;

said bracing means including: a plurality of tension rods extending through said plates and said chamber; a plurality of bracing elements connected to corresponding ones of said tension rods at one end thereof and adapted to engage and disengage said recess means; and, bracing means at the respective other ends of said tension rods for bracing said rods to the upper one of said plates when said chamber is charged with said pressure medium for displacing said one plate for applying said load to said cover.

13. The container of claim 12, said tensioning unit including a plurality of sealing sleeves disposed in surrounding relationship to corresponding ones of said tension rods for sealing said chamber with respect to said plates.

14. The container of claim 12, said bracing means including a plurality of yokes resting on top of the upper one of said plates and corresponding to respective ones of said tension rods, each of said yokes having a pivot pin for pivotally connecting the tension rod thereto so as to be pivotable with respect thereto.

15. The container of claim 8, said tensioning unit including: two mutually parallel plates disposed one above the other and in spaced relationship to each other, the lower one of said plates defining said end face; and, a bellows connecting said plates to each other so as to cause said bellows and said plates to conjointly define a chamber for receiving a pressure medium therein; said plates extending outwardly beyond the periphery of said bellows;

said bracing means including: a plurality of tension rods extending through said plates outside of said periphery of said bellows; and, a plurality of bracing elements connected to corresponding ones of said tension rods at one end thereof and adapted to engage and disengage said recess means; and, bracing means at the respective other ends of said tension rods for bracing said rods to the upper one of said plates when said chamber is charged with said pressure medium for displacing said one plate for applying said load to said cover.

16. The container of claim 15, said bracing means including a plurality of yokes resting on top of the upper one of said plates and corresponding to respective ones of said tension rods, each of said yokes having a pivot pin for pivotally connecting the tension rod thereto so as to be pivotable with respect thereto.

* * * * *